US005629759A

United States Patent [19]

Jyoroku

[11] Patent Number: 5,629,759

[45] Date of Patent: May 13, 1997

[54] DEVELOPING DEVICE WITH A DETACHABLY MOUNTED TONER CARTRIDGE

[75] Inventor: Kazuo Jyoroku, Osaka, Japan

[73] Assignee: Mita Industrial Co., Ltd., Japan

[21] Appl. No.: 616,187

[22] Filed: Mar. 15, 1996

[30] Foreign Application Priority Data

Apr. 5, 1995 [JP] Japan ..... 7-80047

[51] Int. Cl.[6] ..... G03G 15/06

[52] U.S. Cl. ..... 399/262; 222/DIG. 1; 399/103; 399/110

[58] Field of Search ..... 355/245, 260, 355/200, 210; 222/DIG. 1; 141/363, 364

[56] References Cited

U.S. PATENT DOCUMENTS

| | | | |
|---|---|---|---|
| 4,060,105 | 11/1977 | Feldeisen et al. | 141/363 X |
| 4,937,628 | 6/1990 | Cipolla et al. | 355/260 |
| 5,040,024 | 8/1991 | Fukuda et al. | 355/260 |
| 5,402,216 | 3/1995 | Komaki et al. | 355/260 |
| 5,515,143 | 5/1996 | Shiotani | 355/260 |

FOREIGN PATENT DOCUMENTS

| | | |
|---|---|---|
| 604991 | 7/1994 | European Pat. Off. . |
| 668546 | 8/1995 | European Pat. Off. . |
| 2268726 | 1/1994 | United Kingdom . |

OTHER PUBLICATIONS

European Search Report for No. EP 96 30 2033 completed 15 Jul. 1996.

*Primary Examiner*—Matthew S. Smith

*Attorney, Agent, or Firm*—Beveridge, DeGrandi, Weilacher & Young, L.L.P.

[57] ABSTRACT

A developing device includes a toner cartridge receiver, and a toner cartridge. The toner cartridge includes a container body having a toner discharge opening, and a shutter member mounted on the container body so as to be free to reciprocate between a closing position where it covers the toner discharge opening and an opening position where it is displaced from the toner discharge opening. By bringing the container body to the position of insertion, and then moving it to the position of mounting, the toner cartridge is detachably mounted on the toner cartridge receiver. The toner cartridge receiver is provided with a shutter member forwarding means and a shutter member returning means which, when the container body is brought to the position of insertion, are situated so as to face the shutter member, thereby inhibiting the movement of the shutter member. When the container body is moved from the position of insertion to the position of mounting, the shutter member is forwarded relatively from the closing position to the opening position. When the container body is moved from the position of mounting to the position of insertion, the shutter member is returned relatively from the opening position to the closing position.

3 Claims, 6 Drawing Sheets

DEVELOPING DEVICE WITH A DETACHABLY MOUNTED TONER CARTRIDGE

FIELD OF THE INVENTION

This invention relates to a developing device of a type in which a toner cartridge accommodating a toner for use in the development of a latent electrostatic image is mounted detachably.

DESCRIPTION OF THE PRIOR ART

An electrostatic copying machine, an electrostatic printer or an electrostatic facsimile is equipped with a developing device for developing a latent electrostatic image formed on an image bearing member. Such a developing device applies a toner to the latent electrostatic image to develop it to a toner image. Usually, the toner consumed as the development proceeds is fed by a toner cartridge mounted detachably at a required position of the developing device. When the toner in the toner cartridge is used up, the toner cartridge is replaced by a new one.

Japanese Patent Publication No. Hei 3-27906 and Japanese Utility Model Publication No. 4-32688 each disclose a developing device on which a toner cartridge accommodating a toner is detachably mounted. The toner cartridge comprises a container body having a toner discharge opening, a shutter member mounted on the container body so as to be free to reciprocate between an closing position where it covers the toner discharge opening and an opening position where it is displaced from the toner discharge opening, and a flexible band-like sealing member having opposite end portions joined to the container body to surround the shutter member in the direction of the above reciprocation. In a state in which the toner cartridge is mounted on the developing device and the toner accommodated inside is discharged through the toner discharge opening, the shutter member is situated at the closing position, and that sealing portion of the sealing member which lies between the shutter member and the container body is bonded strippably to the container body at the peripheral edge of the toner discharge opening, thus sealing the toner discharge opening. After the toner cartridge is mounted at the required position of the developing device, the shutter member is forwarded manually from the closing position to the opening position. In accordance with the forward movement of the shutter member, the sealing portion of the sealing member is stripped from the container body and displaced from the toner discharge opening. Thus, the toner discharge opening is unclosed, and the toner inside the container body is discharged, where necessary, through the unclosed toner discharge opening. When the toner cartridge is to be released from the developing device for replacement, prior steps to be taken are to return the shutter member manually from the opening position to the closing position, and cover the toner discharge opening again with the sealing portion of the sealing member moved according to the return movement of the shutter member. These prior steps prevent the toner remaining inside the container body from falling through the toner discharge opening and scattering to the surroundings, or from adhering to the operator's hand, etc.

The above-described developing device requires that after mounting the toner cartridge at the required position of mounting on the developing device, the shutter member be forwarded by a manual operation in order to unclose the toner discharge opening. It also requires that before releasing the toner cartridge from the developing device, the shutter member be returned by a manual operation in order to close the toner discharge opening. Thus, operations on the toner cartridge are relatively tiresome.

SUMMARY OF THE INVENTION

The object of this invention is to improve a toner cartridge receiver in the developing device of the above-mentioned type having the toner cartridge mounted thereon such that when the toner cartridge is to be mounted at a predetermined position of mounting on the developing device, the shutter member is automatically forwarded relative to the container body to unclose the toner discharge opening, and when the toner cartridge is to be released from the predetermined position of mounting on the developing device, the shutter member is automatically returned relative to the container body to close the toner discharge opening, and that these movements are made without involving problems such as the problem of making the structure of the toner cartridge receiver of the developing device uselessly complicated.

We have conducted extensive research, and found that the above object can be attained by providing the toner cartridge receiver with a shutter member forwarding means and a shutter member returning means which may be simple structures such as mere ridges, and by providing the following contrivances: When the toner cartridge is to be mounted at the predetermined position of mounting on the developing device, the shutter member is inhibited by the shutter member forwarding means from moving in the direction of its returning motion as an accompaniment to the container body, and is thus automatically forwarded relative to the container body to unclose the toner discharge opening, while when the toner cartridge is to be released from the predetermined position of mounting on the developing device, the shutter member is inhibited by the shutter member returning means from moving in the direction of its forwarding motion as an accompaniment to the container body, and is thus automatically returned relative to the container body to close the toner discharge opening.

That is, the present invention provides a developing device resolving the above-described technical challenge, which comprises a toner cartridge receiver, and a toner cartridge to be mounted detachably on the toner cartridge receiver, wherein the toner cartridge includes a container body having a toner discharge opening, a shutter member mounted on the container body so as to be free to reciprocate between a closing position where it covers the toner discharge opening and an opening position where it is displaced from the toner discharge opening, and a flexible band-like sealing member; the shutter member is situated at the closing position, and that sealing portion of the sealing member which lies between the container body and the shutter member is bonded strippably to the container body at the peripheral edge of the toner discharge opening, thus sealing the toner discharge opening; when the shutter member is forwarded from the closing position to the opening position, the sealing portion of the sealing member is stripped from the container body and displaced from the toner discharge opening to unclose the toner discharge opening, while when the shutter member is returned from the opening position to the closing position, the sealing portion of the sealing member and the shutter member cover the toner discharge opening again;

by inserting the container body of the toner cartridge to a predetermined position of insertion in a direction perpendicular to the direction of the reciprocation of the shutter member, and then moving the container body to a predetermined position of mounting in the direction of the returning of the shutter member relative to the container body in the toner cartridge, the toner cartridge is mounted on the toner cartridge receiver; by moving the container body of the toner cartridge from the position of mounting to the position of insertion in the direction of the forwarding of the shutter member relative to the container body in the toner cartridge, and then withdrawing the container body in a direction perpendicular to the direction of the reciprocation of the shutter member, the toner cartridge is released from the toner cartridge receiver;

the toner cartridge receiver is provided with a shutter member forwarding means and a shutter member returning means; when the toner cartridge is inserted as far as the position of insertion, the shutter member forwarding means is positioned so as to face the rear edge of the shutter member when viewed in the direction of the forwarding of the shutter member relative to the container body, while the shutter member returning means is positioned so as to face the rear edge of the shutter member when viewed in the direction of the returning of the shutter member relative to the container body; when the container body is moved from the position of insertion to the position of mounting, the shutter member is inhibited by the shutter member forwarding means from moving as an accompaniment to the container body, and is thus forwarded relative to the container body to unclose the toner discharge opening; and when the container body is moved from the position of mounting to the position of insertion, the shutter member is inhibited by the shutter member returning means from moving as an accompaniment to the container body, and is thus returned relative to the container body to cover the toner discharge opening again with the sealing portion of the sealing member and the shutter member.

The sealing member in the toner cartridge is advantageously the one whose opposite end portions are directly joined together, or are joined to the container body, to surround the shutter member in the direction of its reciprocation. Preferably, the toner cartridge receiver is provided with a guide means, while the container body of the toner cartridge is provided with a guided means, and the guide means and the guided means act cooperatively to prevent the container body of the toner cartridge from being inserted to and withdrawn from the position of insertion in a manner deviated in the direction of the reciprocation of the shutter member relative to the container body; to prevent the container body of the toner cartridge from being moved past the position of insertion in a direction perpendicular to the direction of the reciprocation of the shutter member relative to the container body; to prevent the container body of the toner cartridge from moving from the position of insertion in the direction of the forwarding of the shutter member relative to the container body; and to prevent the container body of the toner cartridge from moving from the position of mounting in the direction of the returning of the shutter member relative to the container body.

In the developing device constructed in accordance with the present invention, when the container body of the toner cartridge is mounted at the predetermined position of mounting in compliance with the required procedure, the shutter member is forwarded relative to the container body by the action of the shutter member forwarding means so as to be brought to the opening position; whereas when the container body of the toner cartridge is released from the predetermined position of mounting in compliance with the required procedure, the shutter member is automatically returned relative to the container body by the action of the shutter member returning means so as to be brought to the closing position.

DETAILED DESCRIPTION OF THE PREFERRED EMBODIMENTS

The present invention will be described in more detail by reference to the appended drawings showing a preferred embodiment of the developing device constructed in accordance with the present invention.

Figure 1:
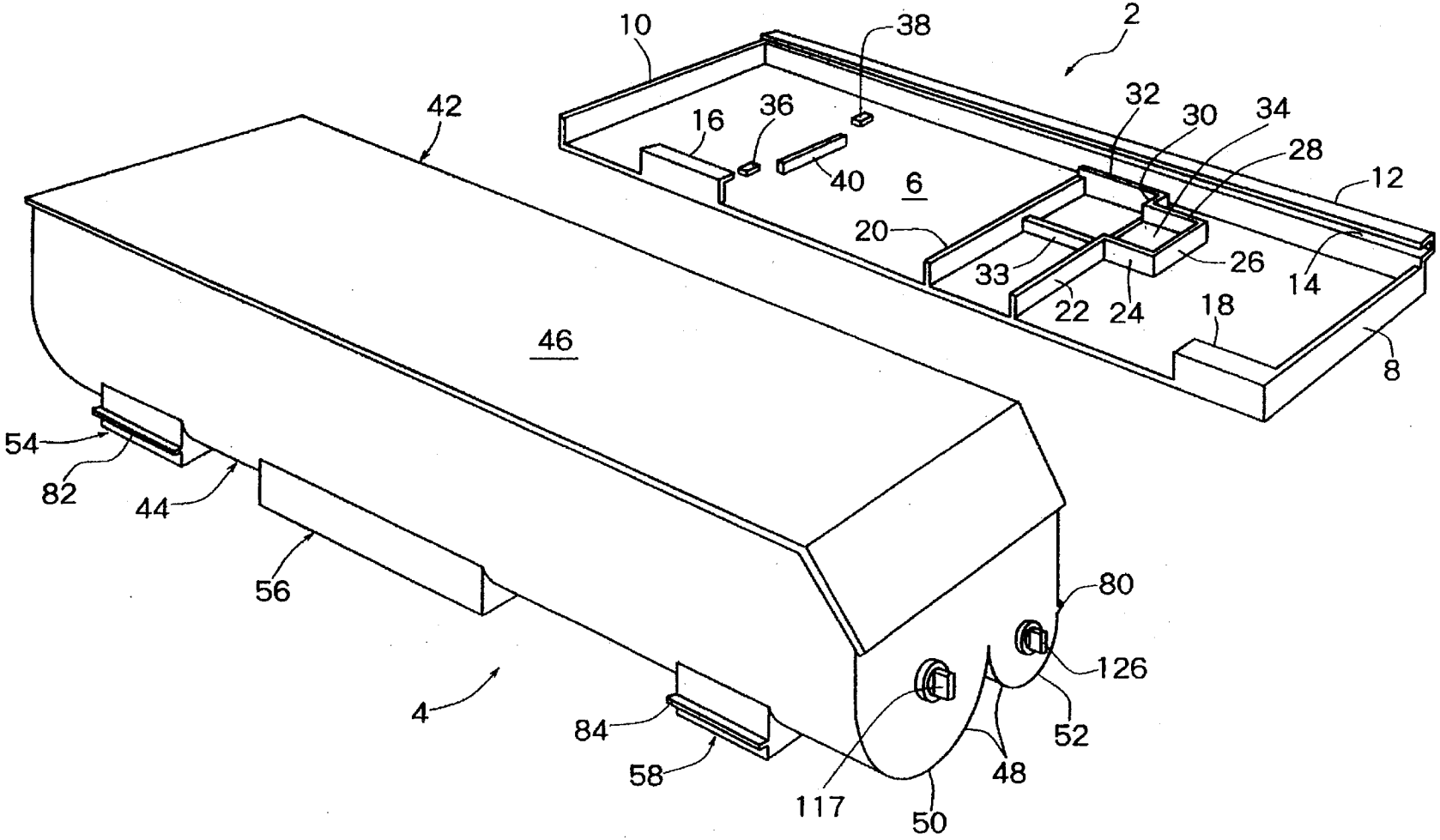
FIG. 1 is an exploded perspective view showing the toner cartridge receiver and the toner cartridge in a preferred embodiment of the developing device constructed in accordance with the present invention.

With reference to FIG. 1, the illustrated developing device includes a toner cartridge receiver indicated entirely at the numeral 2, and a toner cartridge indicated entirely at the numeral 4. A development housing (not shown) is disposed below the toner cartridge receiver 2. Inside such a development housing is disposed a developing means (not shown), such as a magnetic brush mechanism, for performing a developing action by which to apply a toner to a latent electrostatic image to develop it to a toner image.

The toner cartridge receiver 2, which may be integrally molded from a suitable plastic material, has a substantially horizontally extending rectangular bottom wall 6. At the opposite side edges of the bottom wall 6 are formed upright side walls 8 and 10, and a rear end wall 12 is formed at the rear edge of the bottom wall 6. The transverse section of an upper portion of the rear end wall 12 is in the shape of a channel open at its front surface. On the front surface of the upper portion of the rear end wall 12 is defined a substantially horizontally extending cartridge engaging groove At the front edge of the bottom wall 6 are formed a pair of cartridge engaging pieces 16 and 18 spaced widthwise. Each of the cartridge engaging pieces 16 and 18 extends from the bottom wall 6 substantially vertically upwards, and extends substantially horizontally rearwards. One end of the cartridge engaging piece 18 is connected to the side wall 8. On the top of the bottom wall 6 are also formed upright guide ridges 20, 22, 24, 26, 28, 30 and 32. The guide ridge 20 extends from the front edge of the bottom wall 6 to a site near the rear edge of the bottom wall 6 in parallel with the opposite side walls 8 and 10. The guide ridge 22 extends from the front edge of the bottom wall 6 rearwards parallel to the guide ridge 20 at a predetermined distance in the width direction from the guide ridge 20. The guide ridge 24 extends from the rear end of the guide ridge 22 toward the side wall 8 substantially parallel to the rear end wall 12. The guide ridge 26 extends rearwards parallel to the guide ridge 22 as a continuation of the guide ridge 24. The guide ridge 28 extends from the rear end of the guide ridge 26 toward the side wall 10 parallel to the guide ridge 24. The guide ridge 30 extends rearwards by some length parallel to the guide ridge 20 as a continuation of the guide ridge 28. The guide ridge 32 extends from the rear end of the guide ridge 30 toward the side wall 10 parallel to the rear end wall 12 until it is connected to the rear end of the guide ridge 20. Between the guide ridges 20 and 22 is formed an auxiliary ridge 33 extending substantially on the same line as the guide ridge 24. In a region lying between the guide ridges 24 and 28 on the bottom wall 6 is formed a toner passage opening 34. On the top of the bottom wall 6 are further formed a pair of locking projections 36 and 38 spaced in the back-and-forth direction, and a locking ridge 40 placed between the pair of locking projections 36 and 38. As will be clearly understood from a description to be offered later, the side walls 8 and 10 and the engaging pieces 16 and 18 formed in the toner cartridge receiver 2, and the guide ridges 20, 22, 24, 26, 28, 30 and 32 formed on the top of the bottom wall 6 constitute a guide means which works cooperatively with a guided means formed in the toner cartridge 4 when the toner cartridge 4 is mounted on and released from the toner cartridge receiver 2. Moreover, a rear end portion of the guide ridge 20 constitutes a shutter member returning means, while a rear end portion of the guide ridge 22 and the guide ridge 30 constitute a shutter member forwarding means.

Figure 2:
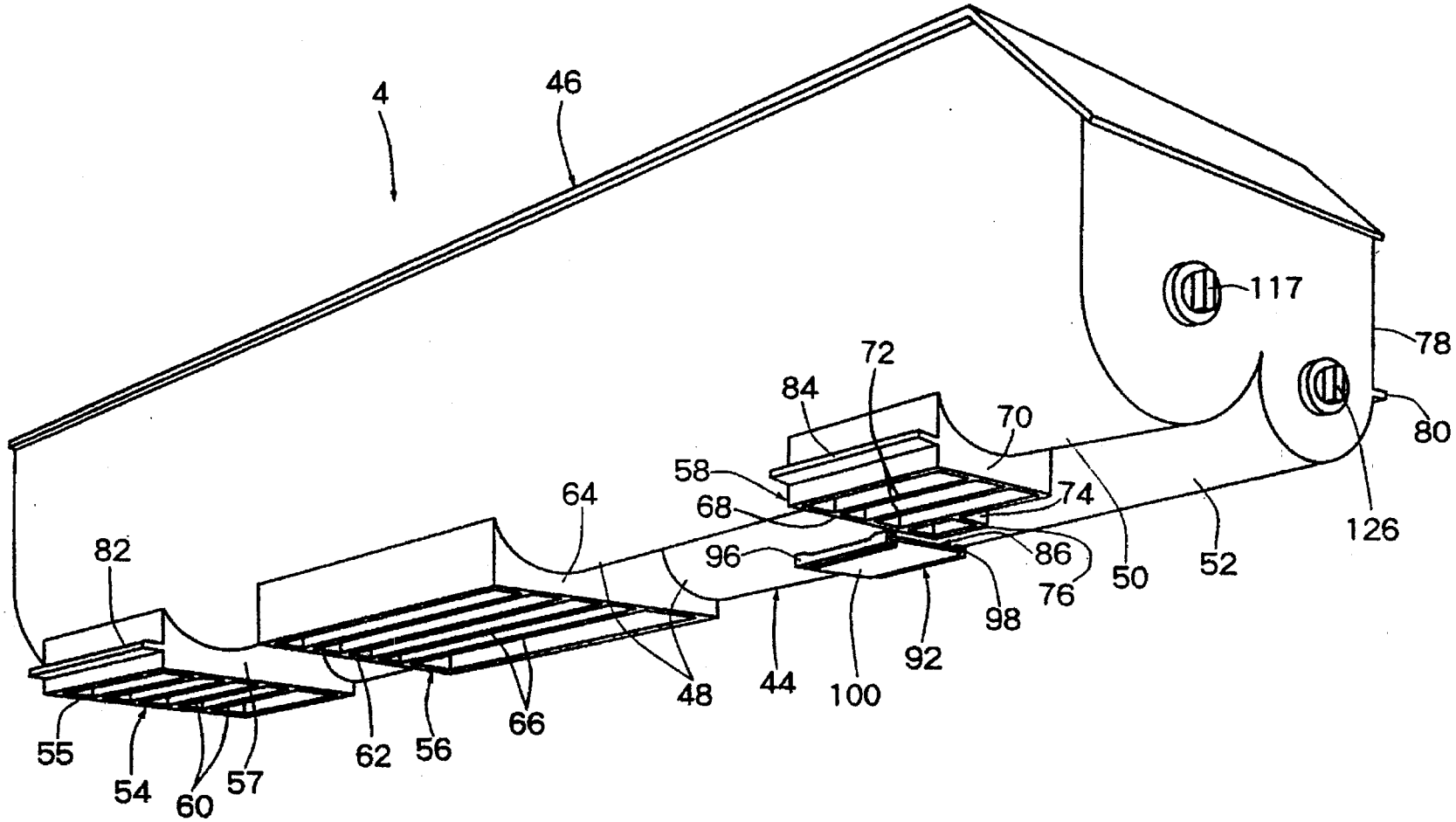
FIG. 2 is a perspective view of the toner cartridge of FIG. 1 as viewed from below.
Figure 3:
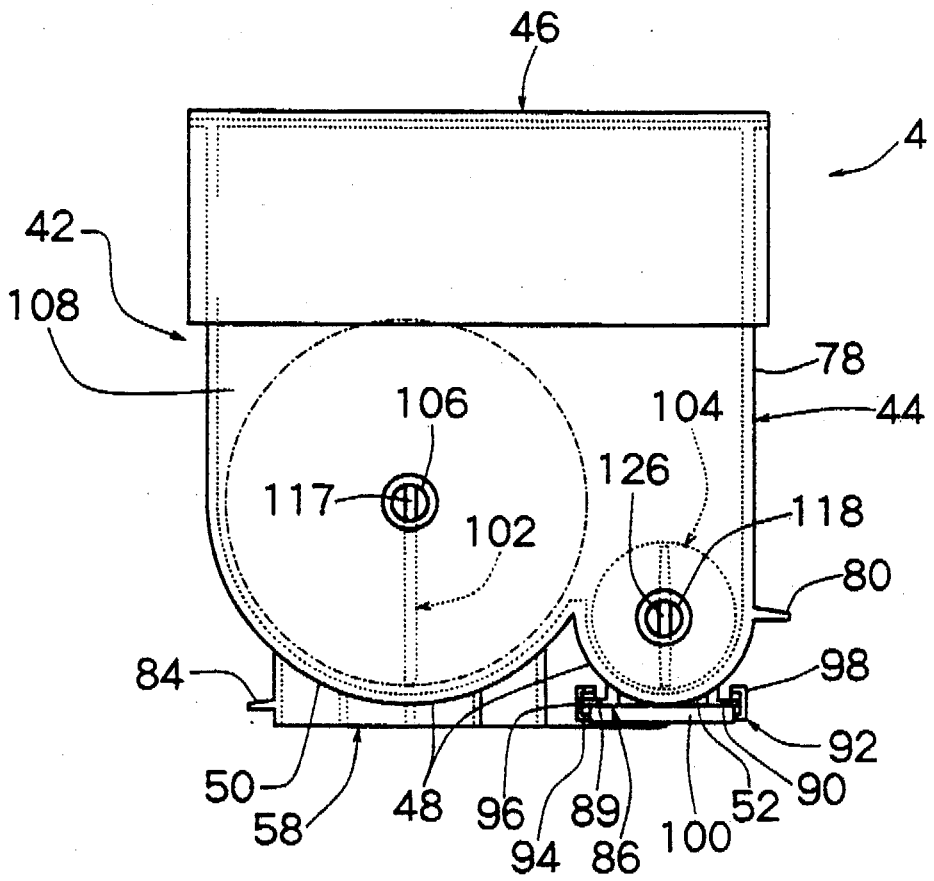
FIG. 3 is a side view of the toner cartridge shown in FIG. 1.
Figure 4:
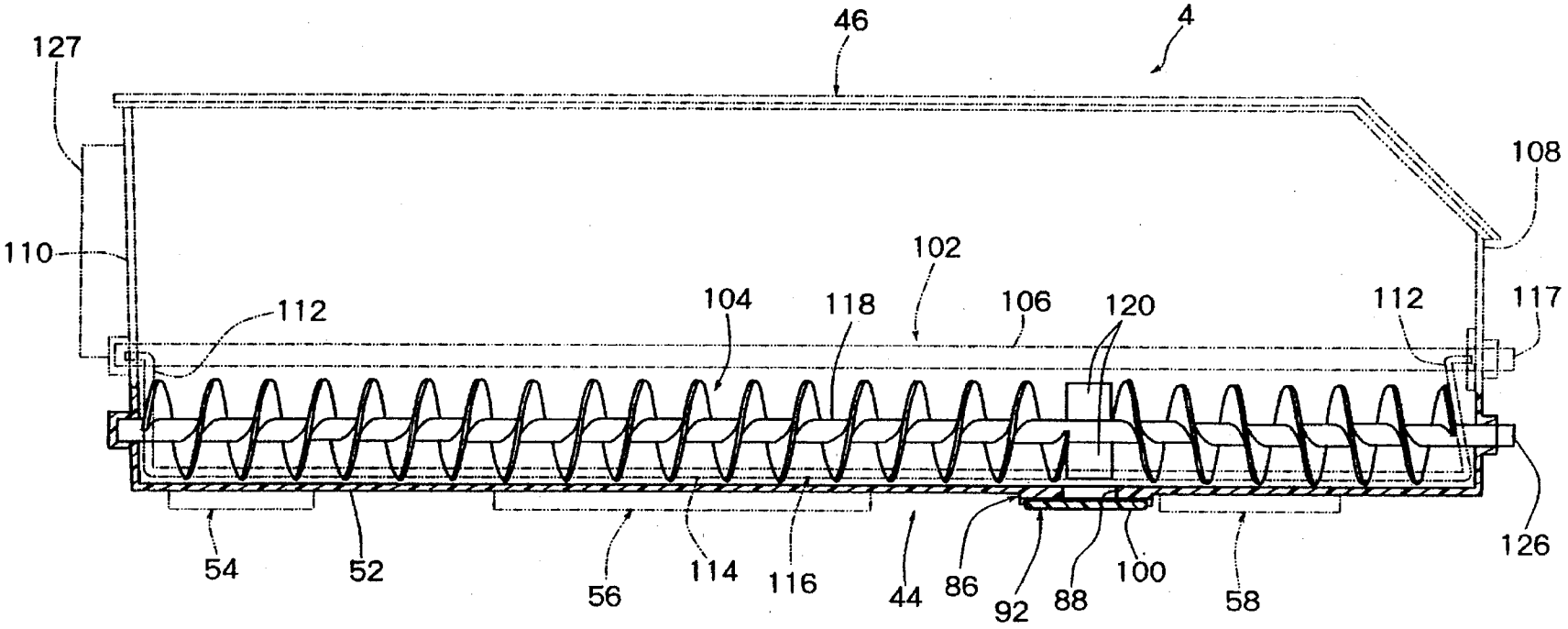
FIG. 4 is a longitudinal sectional view of the toner cartridge shown in FIG. 1.
Figure 5:
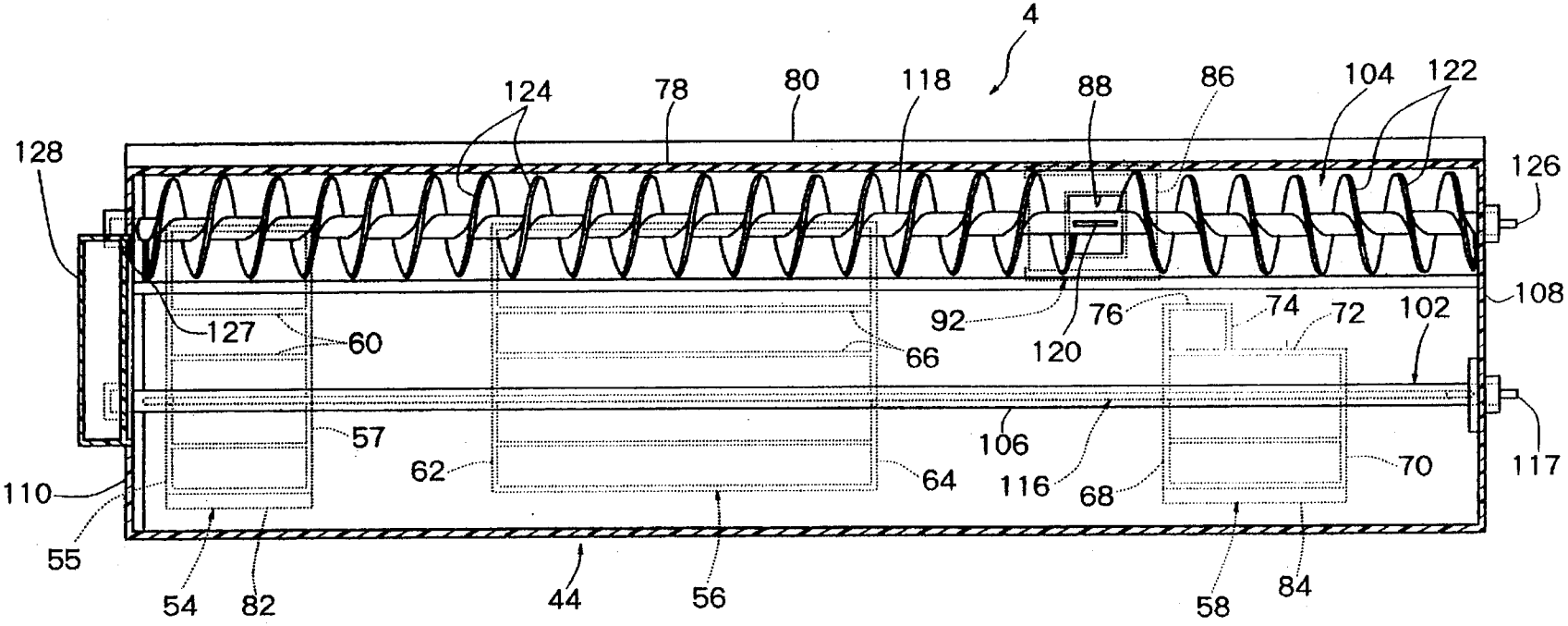
FIG. 5 is a transverse sectional view of the toner cartridge shown in FIG. 1.

With reference to FIGS. 2 and 3 along with FIG. 1, the toner cartridge 4 has a container body 42. The container body 42 is composed of a box-like main portion 44 open upwards, and a cover portion The main portion 44 and the cover portion 46 may be molded from a suitable plastic material. The cover portion 46 is fixed to the upper surface of the main portion 44 by a suitable method such as bonding or welding to close the upper surface of the main portion 44. As will be seen clearly from FIG. 3, a front part 50 of the bottom wall 48 of the main portion 44 has a cross section in the shape of an arc with a relatively large radius of curvature, while a rear part 52 of the bottom wall 48 has a cross section in the shape of an arc with a relatively small radius of curvature. (As will be mentioned later, however, the rear part 52 of the bottom wall 48 also has a flat portion rather than the arcuate portion.) With reference to FIGS. 4 and 5 together with FIGS. 1 to 3, the lower surface or outer surface of the bottom wall 48 of the main portion 44 has first to third groups of ridges 54, 56 and 58. The first group of ridges 54 include a pair of guided ridges 55 and 57 extending in the back-and-forth direction (the up-and-down direction in FIGS. 4 and 5) at a distance in the width direction (the right-and-left direction in FIGS. 4 and 5), and a plurality of reinforcing ridges 60 extending widthwise between the guided ridges 55 and 57. The second group of ridges 56 likewise include a pair of guided ridges 62 and 64 extending in the back-and-forth direction at a distance in the width direction, and a plurality of reinforcing ridges 66 extending widthwise between the guided ridges 62 and 64. The third group of ridges 58 similarly include a pair of guided ridges 68 and 70 extending in the back-and-forth direction at a distance in the width direction, and a plurality of reinforcing ridges 72 extending widthwise between the guided ridges 68 and 70. The third group of ridges 58 also include a reinforcing ridge 74 extending rearwards from the rearmost reinforcing ridge 72 of the plurality of reinforcing ridges 72, and a guided ridge 76 extending widthwise between the rear end of the reinforcing ridge 74 and the rear end of the guided ridge 68. (As will be seen from FIG. 5, the guided ridge 68 is caused to extend rearwards past the rear end of the guided ridge 70.) As illustrated in FIGS. 3 and 5, an engaged piece 80 caused to extend substantially horizontally rearwards is formed at a lower portion of the rear wall 78 of the main portion 44. The engaged piece 80 is caused to extend uninterruptedly nearly throughout the width of the main portion 46. As will be seen by reference to FIGS. 1 to 3, engaged pieces 82 and 84 protruding forward substantially horizontally are formed, respectively, on the foremost reinforcing ridge 60 of the plurality of widthwise extending reinforcing ridges 60 in the first group of ridges 54, and on the foremost reinforcing ridge 72 of the plurality of widthwise extending reinforcing ridges 72 in the third group of ridges 58. As will be seen clearly from a description to be offered later, the pair of guided ridges 55 and 57 of the first group of ridges 54, the pair of guided ridges 62 and 64 of the second group of ridges 56, and the pair of guided ridges 68 and 70 as well as the guided ridge 76 of the third group of ridges 58 constitute a guided means which works cooperatively with the guide means disposed in the toner cartridge receiver 2 when the toner cartridge 4 is mounted on and released from the toner cartridge receiver 2.

Figure 6:
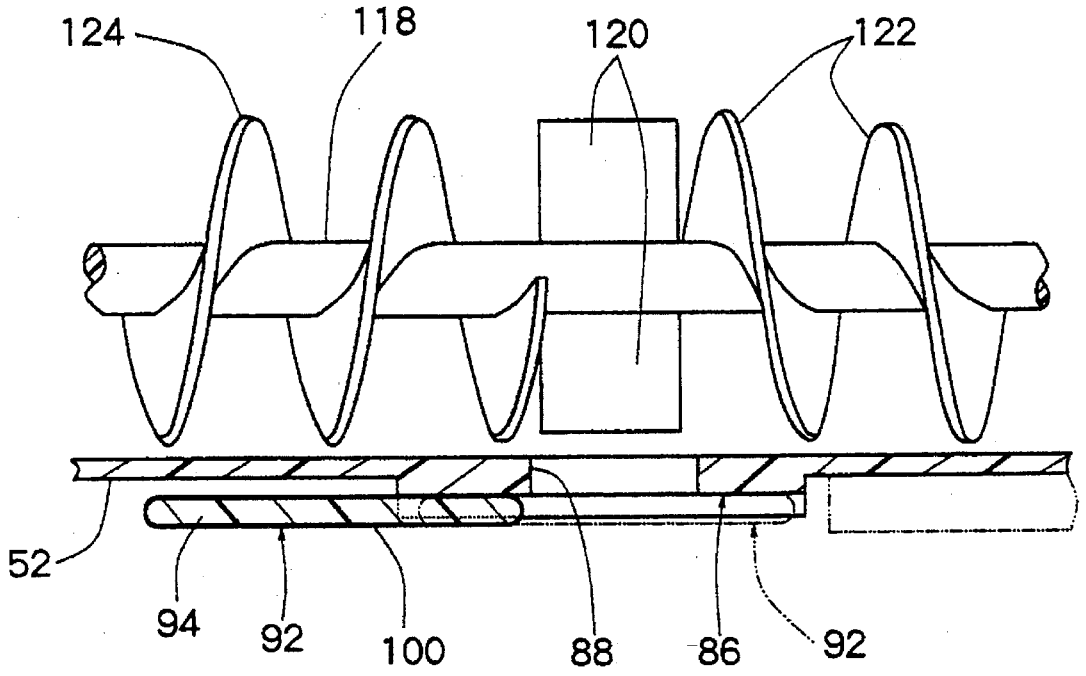
FIG. 6 is a partially sectional view showing the shutter member and the sealing member along with a mouth and neck portion formed in the container body of the toner cartridge shown in FIG. 1.

Further with reference to FIG. 6 along with FIGS. 3 and 5, a mouth and neck portion 86 whose outer surface is a flat surface extending substantially horizontally is present in the rear part 52 of the bottom wall 48 of the main portion 46 in the container body 42. The outer surface or lower surface of the mouth and neck portion 86 preferably is on substantially the same plane as the lowermost portion of the outer surface of the arcuate portion in the rear part 52 of the bottom wall 48. The inner surface of the mouth and neck portion 86 may have a cross section in the shape of an arc similar to the other portions. At the center of the mouth and neck portion 86 is formed a rectangular toner discharge opening 88. As shown clearly in FIG. 3, a mounting rail 89 projecting forward substantially horizontally is formed on the front side (the left side in FIG. 3) of the mouth and neck portion 86, while a mounting rail 90 projecting rearward substantially horizontally is formed on the rear side (the right side in FIG. 3) of the mouth and neck portion 86.

A shutter member 92 is mounted on the mounting rails 89 and 90 so as to be free to move widthwise. The shutter member 92, optionally formed from a suitable plastic material, has a rectangular flat plate-like main portion 94, and mounted pieces 96 and 98 formed at the front edge and rear edge of the flat plate-like main portion 94. The mounted piece 96 has an upright portion extending upwards from the front edge of the flat plate-like main portion 94, and a mounted rail projecting rearwards from the upper end of the upright portion. The mounted piece 98 has an upright portion extending upwards from the rear edge of the flat plate-like main portion 94, and a mounted rail projecting forwards from the upper end of the upright portion. Such shutter member 92 is mounted so as to be movable in the width direction of the container body 42, by positioning the mounting rails 89 and 90, formed in the mouth and neck portion 86 in the bottom wall 48 of the container body 42, between front and rear edge portions of the flat plate-like main portion 94 and the mounted rails of the mounted pieces 96 and 98. In a state in which the toner cartridge 4 is mounted on the toner cartridge receiver 2 as will be described later, the shutter member 92 is brought to a closing position indicated by a solid line in FIGS. 5 and 6 to cover the mouth and neck portion 86 where the toner discharge opening 88 in the bottom wall 48 of the container body 42 is formed.

As will be seen by reference to FIGS. 3 and 6, a sealing member 100 is disposed in conjunction with the toner discharge opening 86 and the shutter member 92. The sealing member 100, optionally formed from a suitable plastic material, is made endless by joining together its opposite end portions of a band-like shape. The sealing member 100 surrounds the flat plate-like main portion 94 of the shutter member 92 in the direction of reciprocation (the right-and-left direction in FIG. 6) of the shutter member 92. (In other words, the sealing member 100 extends in the direction of the forwarding of the shutter member 92 to surround the inner surface, outer surface and opposite side edges of the flat plate-like main portion 94 of the shutter member 92.) That sealing portion of the sealing member 100 which lies between the container body 42 and the shutter member 92 (accordingly, lies inwardly of the flat plate-like main portion 94 of the shutter member 92) is bonded strippably to the peripheral edge of the toner discharge opening 88 in the bottom wall 48 of the container body 42, i.e., the outer surface of the mouth and neck portion 86 in the bottom wall 48 of the container body 42. Such strippable bonding of the sealing portion of the sealing member 100 can be realized by a suitable method such as welding. Instead of directly joining together the opposite end portions of the sealing member 100 to make the sealing member 100 into an endless form and surround the shutter member 92 with the sealing member 100, it is possible, if desired, to join the opposite end portions of the sealing member to the mouth and neck portion of the bottom wall of the container body as disclosed in the aforementioned Japanese Patent Publication No. Hei 3-27906 or Japanese Utility Model Publication No. 4-32688. This method can surround the shutter member with the sealing member. Instead of surrounding the shutter member with the sealing member, moreover, a free end portion of a folded-back part extending after folding back the sealing portion strippably bonded to the mouth and neck portion of the bottom wall of the container body can be simply joined to the shutter member. As will be understood clearly from a description to be given later, however, the state in which the shutter member 92 is surrounded by the sealing member 100 in the direction of reciprocation of the shutter member 92 is advantageous, because the sealing member 100 is also moved over substantially the same length as the length of reciprocation of the shutter member 100. (If the free end portion of the folded-back part of the sealing member is simply joined to the shutter member without the shutter member being surrounded by the sealing member in the direction of its reciprocation, the length of movement of the sealing member is a half of the length of reciprocation of the shutter member, thus increasing the length of forwarding of the shutter member required to strip the sealing portion of the sealing member from the bottom wall of the container body and unclose the toner discharge opening, and the length of returning of the shutter member required to close the toner discharge opening again with the sealing portion of the sealing member.)

Further with reference to FIGS. 3 to 5, a first toner conveying mechanism 102 and a second toner conveying mechanism 104 are disposed inside the container body 42 of the toner cartridge 4. The first toner conveying mechanism 102 has a rotating shaft 106 extending widthwise substantially horizontally above the front part 50 of the bottom wall 48. The rotating shaft 106 is mounted rotatably between opposite side walls 108 and 110 in the main portion 44 of the container body 42, and is positioned substantially in alignment with the center of curvature of the arcuate cross section of the front part 50 of the bottom wall 48. To the rotating shaft 106 is fixed a conveying member 116 having connecting arm portions 112 extending radially from opposite end portions of the rotating shaft 106, and a conveying portion 114 extending widthwise substantially horizontally between the front ends of the connecting arm portions 112. One end portion of the rotating shaft 106 is caused to protrude outward through the side wall 108 of the main portion 44, and a connecting piece 117 is formed at its protruding end. The second toner conveying mechanism 104 has a rotating shaft 118 extending widthwise substantially horizontally above the rear part 52 of the bottom wall 48. The rotating shaft 118 is mounted rotatably between the opposite side walls 108 and 110 in the main portion 44 of the container body 42, and is positioned substantially in alignment with the center of curvature of the arcuate cross section of the rear part 52 of the bottom wall 48. To the rotating shaft 118 are fixed a pair of discharge blades 120, and helical blades 122 and 124. The pair of discharge blades 120 are plate-like pieces protruding radially from the rotating shaft 118 at a 180°-angle distance therebetween, and are positioned above the toner discharge opening 88 in alignment with it. The helical blade 122 extends between the side wall 108 and the discharge blade 120, while the helical blade 124 extends between the side wall 110 and the discharge blade 120. The direction of the helix of the helical blade 122 and that of the helical blade 124 are made opposite to each other. One end portion of the rotating shaft 118 is caused to protrude outward through the side wall 108, and a connecting piece 126 is formed on the end surface of the protrusion. The container body 42 of the toner cartridge 4 is further filled with a required amount of a toner (not shown). Such a toner can be filled into the container body 42 through a fill opening 127 formed in the side wall 110 (FIGS. 5 and 6). After filling of the toner, a closing member 128 is fixed to the side wall 110 by bonding, welding or the like to close the fill opening.

Next, the ways of mounting and releasing the toner cartridge 4 on or from the toner cartridge receiver 2 will be explained. In mounting the toner cartridge 4 on the toner cartridge receiver 2, the bottom wall 48 of the toner cartridge 4 is located on the bottom wall 6 of the toner cartridge receiver 2, and the toner cartridge 4 is moved rearwards (upwards in FIG. 5). On this occasion, the first group of ridges 54 formed on the bottom wall 48 of the toner cartridge 4 are inserted widthwise between the side wall 10 and the cartridge engaging piece 16 of the toner cartridge receiver 2, the second group of ridges 56 formed on the bottom wall 48 of the toner cartridge 4 are inserted widthwise between the cartridge engaging piece 16 and the guide ridge 20 of the toner cartridge receiver 2, and the third group of ridges 58 formed on the bottom wall 48 of the toner cartridge 4 are inserted widthwise between the guide ridge 22 and the cartridge engaging piece 18 of the toner cartridge receiver 2. The width of the first group of ridges 54 is consistent with the width between the side wall 10 and the cartridge engaging piece 16, and the width of the third group of ridges 58 is consistent with the width between the guide ridge 22 and the cartridge engaging piece 18. Thus, when the toner cartridge 4 is moved rearwards relative to the toner cartridge receiver 2, the toner cartridge 4 is prevented from being displaced widthwise relative to the toner cartridge receiver 2. The width of the second group of ridges 56 is smaller by a predetermined dimension than the width between the cartridge engaging piece 16 and the guide ridge 20, so that a distance of a predetermined dimension exists between the second group of ridges 56 and the guide ridge 20. When the toner cartridge 4 is moved rearwards to a predetermined position of insertion relative to the toner cartridge receiver 2, the engaged piece 80 formed on the rear wall 78 of the toner cartridge 4 is advanced into the cartridge engaging groove 14 formed in the rear end wall 12 of the toner cartridge receiver 2. At the same time, a lower end portion of the rear wall 78 of the toner cartridge 4 is contacted with the rear end wall 12 of the toner cartridge receiver 2. Furthermore, the rear end of the shutter member 92 of the toner cartridge 4 (i.e., the mounted piece 98) is contacted with the guide ridge 32 of the toner cartridge receiver 2. Hence, the toner cartridge 4 is reliably inhibited from moving rearwards further.

Once the toner cartridge 4 is moved to the predetermined position of insertion in the manner described above, the rear end portion of the guide ridge 22 and the guide ridge 30 in the toner cartridge receiver 2 are positioned so as to face one edge of the shutter member 92 of the toner cartridge 4. Thus, the shutter member 92 is inhibited from moving in the direction of returning (the rightward direction in FIGS. 4 to 6). One edge of the mouth and neck portion 86 where the shutter member 92 is mounted is located between the guide ridges 24 and 28, so that the container body 42 of the toner cartridge 4 can move in the direction of returning. When the toner cartridge 4 has been moved rearwards as far as the predetermined position of insertion, the rear end portion of the guide ridge 20 of the toner cartridge receiver 2 is located so as to face the other edge of the shutter member 92 of the toner cartridge 4 and the other edge of the mouth and neck portion 86 of the container body 42. Thus, the shutter member 92 is inhibited from moving in the direction of forwarding (the leftward direction in FIGS. 4 to 6), with the movement of the container body 42 in the direction of forwarding being also inhibited. When the toner cartridge 4 has been moved rearwards as far as the predetermined position, the first group of ridges 54 and the third group of ridges 58 of the toner cartridge 4 come past and behind the substantially vertically upwardly extending upright portion of the cartridge engaging piece 16 and the substantially vertically upwardly extending upright portion of the cartridge engaging piece 18 in the toner cartridge receiver 2. Thus, it becomes possible for the container body 42 of the toner cartridge 4 to move in the direction of returning (the direction of returning of the shutter member 92 relative to the container body 42). Then, when the container body 42 of the toner cartridge 4 is moved in the direction of returning as far as a predetermined position of mounting, a lower end portion of the side wall 108 of the container body 42 contacts the side wall 8 of the toner cartridge receiver 2, the second group of ridges 56 formed on the bottom wall 48 of the container body 42 contact the guide ridge 20 of the toner cartridge receiver 2, and one edge of the mouth and neck portion 86 formed in the bottom wall 48 of the container body 42 contacts the guide ridge 26 of the toner cartridge receiver 2, thereby inhibiting the container body 42 from moving further in the direction of returning. Furthermore, the ridge 57 in the first group of ridges 54 formed on the bottom wall of the container body 42 elastically passes over the pair of relatively low locking projections 36 and 38 formed on the bottom wall 6 of the toner cartridge receiver 2, and gets interposed between the pair of locking projections 36 and 38 and the locking ridge 40. Thus, the container body 42 is locked at the position of mounting, so that the container body 42 is elastically prevented from moving in the right-and-left direction in FIGS. 4 to 6 (the direction of reciprocation of the shutter member 92 relative to the container body 42). When the container body 42 is moved in the direction of returning as far as the position of mounting, the engaged piece 82 provided in the first group of ridges 54 formed on the bottom wall 48 of the container body 42 is advanced to a site behind and below the cartridge engaging piece 16 of the toner cartridge receiver 2. Likewise, the engaged piece 84 provided in the third group of ridges 58 formed on the bottom wall 48 of the container body 42 is advanced to a site behind and below the cartridge engaging piece 18 of the toner cartridge receiver 2. Thus, the container body 42 is inhibited from being withdrawn forward (downward in FIG. 5). Coupled with the aforementioned advancement of the engaged piece 80, formed at the rear end 78 of the container body 42, into the cartridge engaging groove 14 of the toner cartridge receiver 2, this advancing of the engaged pieces 82 and 84 of the container body 42 to sites behind and below the cartridge engaging pieces 16 and 18 of the toner cartridge receiver 2 prevents, without fail, the upward displacement of the toner cartridge 4 from the toner cartridge receiver 2.

During the above-mentioned movement of the container body 42 of the toner cartridge 4 from the position of insertion to the position of mounting in the direction of returning, the movement of the shutter member 92 in the direction of returning is inhibited by the rear end portion of the guide ridge 22 and the guide ridge 30. Thus, the shutter member 92 is rendered stationary without being moved, so that the shutter member 92 is moved from the position of closing, indicated by a two-dot chain line in FIG. 6, to the position of opening, indicated by a solid line in FIG. 6 (at this position of opening, the shutter member 92 has been displaced from the toner discharge opening 88), relative to the container body 42 in the direction of forwarding (the leftward direction in FIGS. 4 to 6). As a result, as clearly shown in FIG. 6, the sealing member 100 surrounding the shutter member 92 is also moved in accordance with the forwarding of the shutter member 92. The sealing portion of the sealing member 100 is stripped from the outer surface of the mouth and neck portion 86, and displaced from the toner discharge opening 88 to unclose the toner discharge opening 88. The unclosed toner discharge opening 88 is situated above, and in alignment with, the toner passage opening 34 formed in the bottom wall 6 of the toner cartridge receiver 2. Thus, the toner accommodated in the container body 42 of the toner cartridge 4 is passed through the toner discharge opening 88 and the toner passage opening 34, and fed into the development housing (not shown) disposed below the toner cartridge receiver 2.

When the container body 42 of the toner cartridge 4 has been moved to the position of mounting in the above-described manner, the connecting piece 117 formed at the protruding end of the rotating shaft 106 of the first conveying mechanism 102 is drivingly connected to a transmission gear (not shown), and the connecting piece 126 formed at the protruding end of the rotating shaft 118 of the second conveying mechanism 104 is drivingly connected to a transmission gear (not shown). Thus, the first conveying mechanism 102 and the second conveying mechanism 104 become able to be driven, where necessary, by an electric motor (not shown). The first conveying mechanism 102 is rotationally driven counterclockwise in FIG. 3 to convey the toner from the front part to the rear part of the container body 42. The second conveying mechanism 104 is rotationally driven clockwise in FIG. 3, and its helical blades 122 and 124 convey the toner, present in the rear part of the container body 42, widthwise toward the toner discharge opening while its discharge blades 120 discharge the toner through the toner discharge opening 88.

When the toner accommodated in the container body 42 of the toner cartridge 4 has been used up substantially, the toner cartridge 4 is released from the toner cartridge receiver 2 in the following manner: First, the container body 42 of the toner cartridge 4 is moved from the position of mounting to the position of insertion in the direction of forwarding (the direction of forwarding of the shutter member 92 relative to the container body 42 that is the leftward direction in FIGS. 4 to 6). On this occasion, the ridge 57 in the first group of ridges 54 formed on the bottom wall 48 of the container body 42 elastically passes over the pair of relatively low locking projections 36 and 38 formed on the bottom wall 6 of the toner cartridge receiver 2, thereby releasing the locking of the container body 42 at the position of mounting. When the container body 42 has been moved to the position of insertion, the guided ridge 55 in the first group of ridges 54 formed on the bottom wall 48 of the container body 42, the guided ridge 62 in the second group of ridges 56, and the guided ridge 68 in the third group of ridges 58 are brought into contact with the side wall 10, locking ridge 40 and guide ridge 22, respectively, of the toner cartridge receiver 2. Thus, the container body 42 is inhibited from moving in the direction of forwarding past the position of insertion. When the container body 42 has been moved to the position of insertion, moreover, the engaged piece 82 provided in the first group of ridges 54 formed on the bottom wall 48 of the container body 42, and the engaged piece 84 provided in the third group of ridges 58 are released from the cartridge engaging pieces 16 and 18 of the toner cartridge receiver 2, thus making it possible to withdraw the container body 42 forward (downward in FIG. 5).

During the above-mentioned movement of the container body 42 of the toner cartridge 4 from the position of mounting to the position of insertion in the direction of forwarding, the movement of the shutter member 92 in the direction of forwarding is inhibited by the rear end portion of the guide ridge 20. Thus, the shutter member 92 is rendered stationary without being moved, so that the shutter member 92 is moved from the position of opening, indicated by the solid line in FIG. 6, to the position of closing, indicated by the two-dot chain line in FIG. 6, relative to the container body 42 in the direction of returning (the rightward direction in FIGS. 4 to 6). As a result, the shutter member 92 covers the toner discharge opening 88, and the sealing member 100 surrounding the shutter member 92 is also moved in accordance with the movement of the shutter member 92. The sealing portion of the sealing member 100 is resumed to a state in which it extends along the flat outer surface of the mouth and neck portion 86. Thus, the toner discharge opening 88 is closed again, though not perfectly. Then, the toner cartridge 4 is withdrawn forward to release the toner cartridge 4 from the toner cartridge receiver 2. Usually, some toner remains inside the container body 42 of the toner cartridge 4. However, the toner discharge opening 88 is closed by the sealing portion of the sealing member 100 and the shutter member 92. Thus, the remaining toner is fully prevented from scattering to the surroundings through the toner discharge opening 88.

In the developing device of the present invention, when the container body of the toner cartridge inserted to the position of insertion on the toner cartridge receiver of the developing device is moved from the position of insertion to the position of mounting, the shutter member is inhibited by the shutter member forwarding means from moving as an accompaniment to the container body. Thus, the shutter member is forwarded relatively from the closing position to the opening position, thereby automatically unclosing the toner discharge opening formed in the container body of the toner cartridge. When the container body of the toner cartridge is moved from the position of mounting to the position of insertion on the toner cartridge receiver in order to release the toner cartridge from the toner cartridge receiver of the developing device, the shutter member is inhibited by the shutter member returning means from moving as an accompaniment to the container body. Thus, the shutter member is returned relatively from the opening position to the closing position, thereby automatically closing the toner discharge opening formed in the container body of the toner cartridge. The shutter member forwarding means and the shutter member returning means may be simple structures such as mere ridges, and do not make the construction of the toner cartridge receiver uselessly complicated.

What we claim is:

1. A developing device comprising a toner cartridge receiver, and a toner cartridge to be mounted detachably on the toner cartridge receiver, wherein the toner cartridge includes a container body having a toner discharge opening, a shutter member mounted on the container body so as to be free to reciprocate between a closing position where it covers the toner discharge opening and an opening position where it is displaced from the toner discharge opening, and a flexible band-like sealing member; the shutter member is situated at the closing position, and that sealing portion of the sealing member which lies between the container body and the shutter member is bonded strippably to the container body at the peripheral edge of the toner discharge opening, thus sealing the toner discharge opening; when the shutter member is forwarded from the closing position to the opening position, the sealing portion of the sealing member is stripped from the container body and displaced from the toner discharge opening to unclose the toner discharge opening, while when the shutter member is returned from the opening position to the closing position, the sealing portion of the sealing member and the shutter member cover the toner discharge opening again;

by inserting the container body of the toner cartridge to a predetermined position of insertion in a direction perpendicular to the direction of the reciprocation of the shutter member, and then moving the container body to a predetermined position of mounting in the direction of the returning of the shutter member relative to the container body in the toner cartridge, the toner cartridge is mounted on the toner cartridge receiver; by moving the container body of the toner cartridge from the position of mounting to the position of insertion in the direction of the forwarding of the shutter member relative to the container body in the toner cartridge, and then withdrawing the container body in a direction perpendicular to the direction of the reciprocation of the shutter member, the toner cartridge is released from the toner cartridge receiver;

the toner cartridge receiver is provided with a shutter member forwarding means and a shutter member returning means; when the toner cartridge is inserted as far as the position of insertion, the shutter member forwarding means is positioned so as to face the rear edge of the shutter member when viewed in the direction of the forwarding of the shutter member relative to the container body, while the shutter member returning means is positioned so as to face the rear edge of the shutter member when viewed in the direction of the returning of the shutter member relative to the container body; when the container body is moved from the position of insertion to the position of mounting, the shutter member is inhibited by the shutter member forwarding means from moving as an accompaniment to the container body, and is thus forwarded relative to the container body to unclose the toner discharge opening; and when the container body is moved from the position of mounting to the position of insertion, the shutter member is inhibited by the shutter member returning means from moving as an accompaniment to the container body, and is thus returned relative to the container body to cover the toner discharge opening again with the sealing portion of the sealing member and the shutter member.

2. The developing device of claim 1 wherein the sealing member in the toner cartridge has opposite end portions joined directly to each other or joined to the container body to surround the shutter member in the direction of its reciprocation.

3. The developing device of claim 1 wherein the toner cartridge receiver is provided with a guide means, the container body of the toner cartridge is provided with a guided means, and the guide means and the guided means act cooperatively to prevent the container body of the toner cartridge from being inserted to and withdrawn from the position of insertion in a manner deviated in the direction of the reciprocation of the shutter member relative to the container body; to prevent the container body of the toner cartridge from being moved past the position of insertion in a direction perpendicular to the direction of the reciprocation of the shutter member relative to the container body; to prevent the container body of the toner cartridge from moving from the position of insertion in the direction of the forwarding of the shutter member relative to the container body; and to prevent the container body of the toner cartridge from moving from the position of mounting in the direction of the returning of the shutter member relative to the container body.

* * * * *